US006170461B1

(12) United States Patent
Pursifull

(10) Patent No.: US 6,170,461 B1
(45) **Date of Patent: *Jan. 9, 2001**

(54) THROTTLE VALVE SYSTEM

(75) Inventor: Ross Dykstra Pursifull, Dearborn, MI (US)

(73) Assignee: Visteon Global Technologies, Inc., Dearborn, MI (US)

( * ) Notice: Under 35 U.S.C. 154(b), the term of this patent shall be extended for 0 days.

This patent is subject to a terminal disclaimer.

(21) Appl. No.: 09/482,974

(22) Filed: Jan. 12, 2000

Related U.S. Application Data

(63) Continuation of application No. 09/118,876, filed on Jul. 20, 1998.

(51) Int. Cl.[7] ..... F02D 9/08

(52) U.S. Cl. ..... 123/337; 123/339.15; 123/399; 251/305

(58) Field of Search ..... 123/337, 396, 123/339.15, 403, 399; 251/306, 305

(56) References Cited

U.S. PATENT DOCUMENTS

| | | | | |
|---|---|---|---|---|
| 3,627,261 | * | 12/1971 | Ludeman | 251/305 |
| 4,836,163 | * | 6/1989 | Muschalik | 123/337 |
| 4,860,706 | * | 8/1989 | Suzuki et al. | 123/337 |
| 5,146,887 | * | 9/1992 | Gluchowski et al. | 123/337 |
| 5,465,696 | * | 11/1995 | Gmelin | 123/337 |
| 5,787,861 | * | 8/1998 | Suzuki et al. | 123/396 |
| 5,876,015 | * | 3/1999 | Schaeffer et al. | 251/305 |

* cited by examiner

*Primary Examiner*—Tony M. Argenbright
*Assistant Examiner*—Arnold Castro
(74) *Attorney, Agent, or Firm*—Rhonda McCoy-Pfau

(57) ABSTRACT

An electronic throttle valve for an engine includes a throttle plate with upper and lower reliefs that allows for tight closed in bore sealing and allows the throttle plate to rotate past the maximum airflow position. A unidirectional spring force is used to reduce feedback control problems.

13 Claims, 4 Drawing Sheets

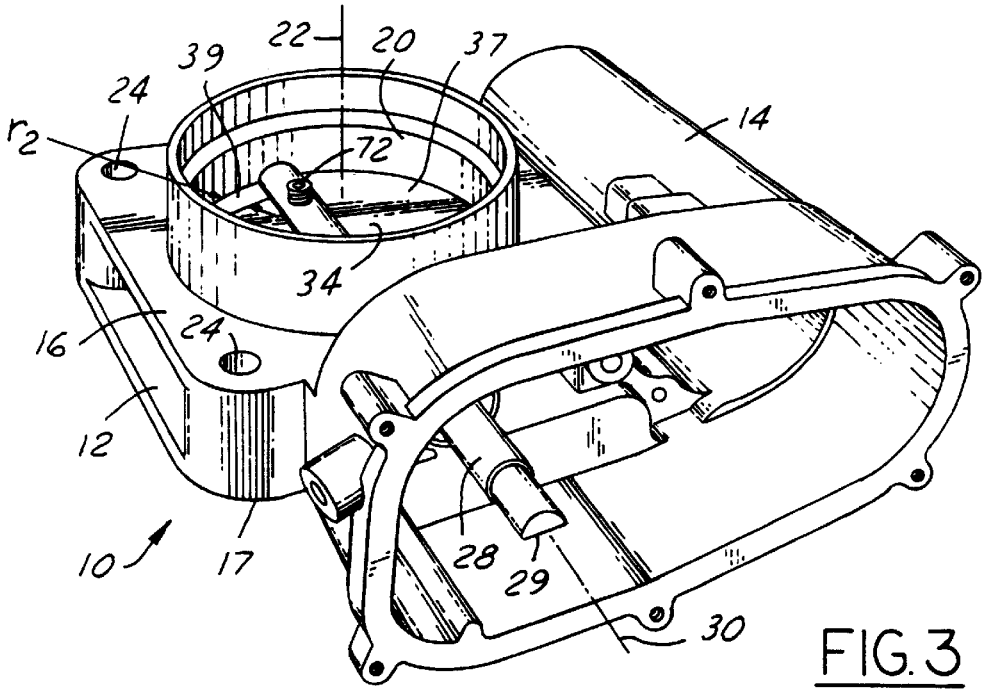
FIG. 3
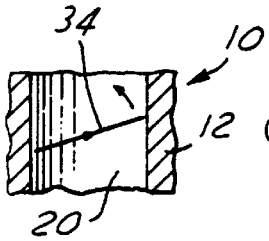
FIG. 4A CLOSED
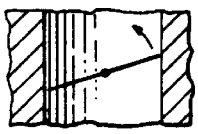
(PRIOR ART) FIG. 4B
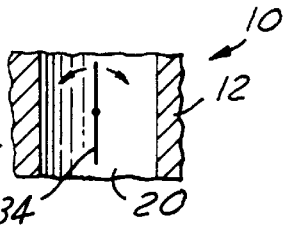
FIG. 4C OPEN
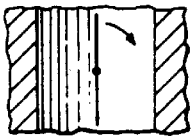
(PRIOR ART) FIG. 4D
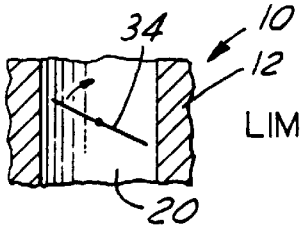
FIG. 4E LIMP-HOME
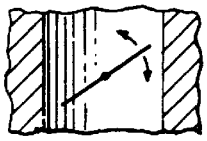
(PRIOR ART) FIG. 4F

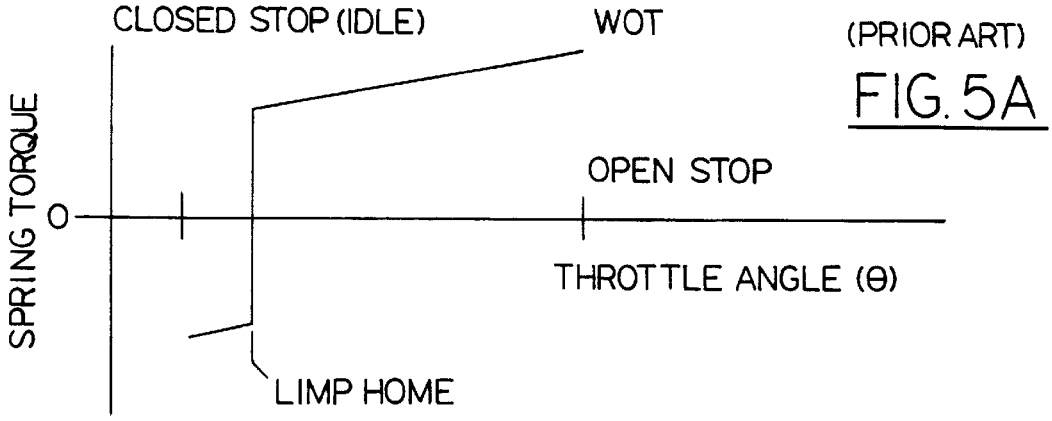
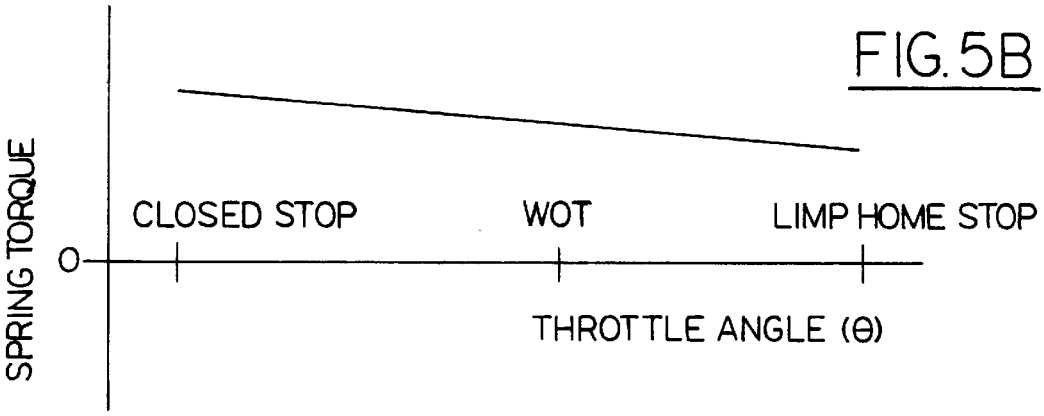
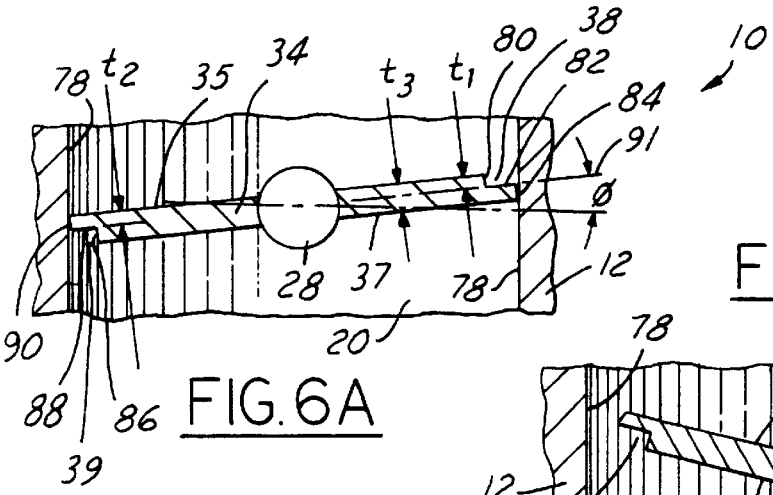
FIG. 6A
FIG. 6B
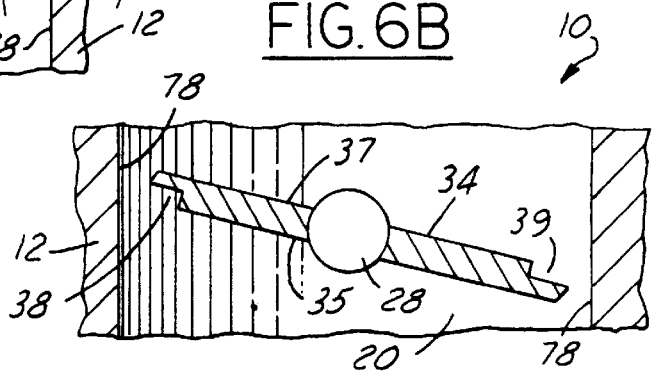

THROTTLE VALVE SYSTEM

This is a continuation of copending application Ser. No. 09/118,876 filed on Jul. 20, 1998.

FIELD OF THE INVENTION

The present invention relates to electronically controlled throttle valve systems for internal combustion engines.

BACKGROUND OF THE INVENTION

Conventional vehicles are governed by the operator through the mechanical connection between the accelerator pedal and the throttle valve that controls the airflow entering the engine. When an electronically controlled throttle is used, the mechanical connection is replaced by an electrical connection. This gives the engine control system greater flexibility in delivering the operation requested by the driver while optimizing constraints related to regulated emissions and fuel economy. However, an additional constraint when using an electronically controlled throttle is that the valve typically includes a so called, "limp home" position. This limp home position allows the throttle to return to a position to allow some airflow through the valve bore, thereby allowing greater valve control under certain engine operating conditions.

One approach to providing a limp home position is to use opposing biasing springs to urge the throttle plate to an intermediate position between the maximum power position (or maximum area position, typically termed WOT) and the minimum power position (or minimum area position). The intermediate position can be selected to provide just enough airflow to idle the engine and provide the limp home mode.

Another approach to providing a limp home position is to use a biasing spring that urges the throttle plate only in one direction to a position past the normally closed throttle position. In other words, the throttle plate is able to rotate in the throttle bore through the closed position to a partially open position. This partially open position can be selected provide to just enough airflow to idle the engine and provide the limp home mode.

The inventor herein has recognized disadvantages with the above approaches. For example, when using opposing biasing springs to urge the throttle plate to an intermediate position between the maximum power position and the minimum power position, there is a discontinuity in the spring force at this intermediate position. In other words, the spring force changes direction at this intermediate position. This causes poor closed loop control performance when the desired throttle plate position is near this intermediate position. The problem is exacerbated in that this intermediate position is selected to be near the normal idling position, which is where throttle plate control is critical. Thus, the total engine control system is extremely sensitive to this discontinuous spring force during a critical engine operating mode. This may cause poor engine idle quality and low customer satisfaction.

Another disadvantage is that the intermediate limp home position can not be easily adjusted. Changing the intermediate position requires changing hardware in a complex mechanism.

When using a biasing spring that urges the throttle plate only in one direction to a position past the closed throttle position, the engine control problem near idle is reduced; however, another control problem becomes more apparent. In particular, it is sometimes necessary to completely restrict the throttle airflow to control the engine due to very low airflow requirements and leaks caused by other air sources, such as, for example, fuel purging and vacuum actuators. Thus, because this prior art does not have a "No Flow" position, the minimum flow position must be adaptively learned as the components wear, expand and contract due to temperature variations, and move do to manufacturing tolerances. In addition, decreasing the flow at the minimum flow position requires increasingly complex and expensive manufacturing processes because the throttle plate must be a perfect circle at the edge with, ideally, infinitesimally small thickness. Indeed, because the throttle plate must rotate through the closed position, it is impossible to completely seal the throttle plate relative to the throttle bore.

Yet another disadvantage is that while the limp home position may be easily adjusted, the minimum flow position can not be easily adjusted. Changing the minimum flow position requires changing hardware and manufacturing processes.

SUMMARY OF THE INVENTION

An object of the invention claimed herein is to provide a throttle valve system for an internal combustion engine that provides a limp home position, allows for simple electronic control, and is easily manufactured.

The above object is achieved, and disadvantages of prior approaches overcome, by providing an electronically controlled throttle valve for use with an internal combustion engine. In one particular aspect of the invention, the valve includes a throttle body adapted for communication between an intake port of the engine and an ambient atmosphere and a throttle plate located in the throttle body. The throttle plate has an upper plate surface having an upper relief and a lower plate surface having a lower relief. The reliefs allow the throttle plate to rotate through a full power position. The valve also includes a biasing spring to bias the throttle plate away from a normal operating range through the full power position to a low power position.

By using a biasing spring urging the throttle plate only in one direction, the controllability problem is due to opposing spring forces is avoided. Also, having the limp home position be past the maximum power position, the necessity and associated manufacturing difficulties with moving the throttle plate through the closed (or minimum flow area) is avoided. Further, a closed in bore, or zero flow, position is possible without addition mechanisms or complex manufacturing.

An advantage of the above aspect of the invention is improved airflow control.

Another advantage of the above aspect of the invention is a simple manufacturing process.

Other objects, features and advantages of the present invention will be readily appreciated by the reader of this specification.

BRIEF DESCRIPTION OF THE DRAWINGS

The object and advantages described herein will be more fully understood by reading an example of an embodiment in which the invention is used to advantage, referred to herein as the Description of the Preferred Embodiment, with reference to the drawings wherein:

FIGS. 1–3 are perspective views of various operating positions of the throttle valve according to the present invention;

FIGS. 4*a*–4*f* are cross-sectional views showing a comparison of throttle plate positions between prior art valves and the valve according to the present invention;

FIGS. 5*a*–5*b* are plots of the spring torque versus the throttle plate angle for prior art valves and the valve of the present invention;

FIGS. 6*a*–6*b* are cross-sectional views showing enlarged views of a throttle plate feature of the present invention; and, FIGS. 7*a* and 7*b* are partial cross-sectional views showing enlarged views of alternative embodiments of the present invention.

BRIEF DESCRIPTION OF THE PREFERRED EMBODIMENT

Figure 1:
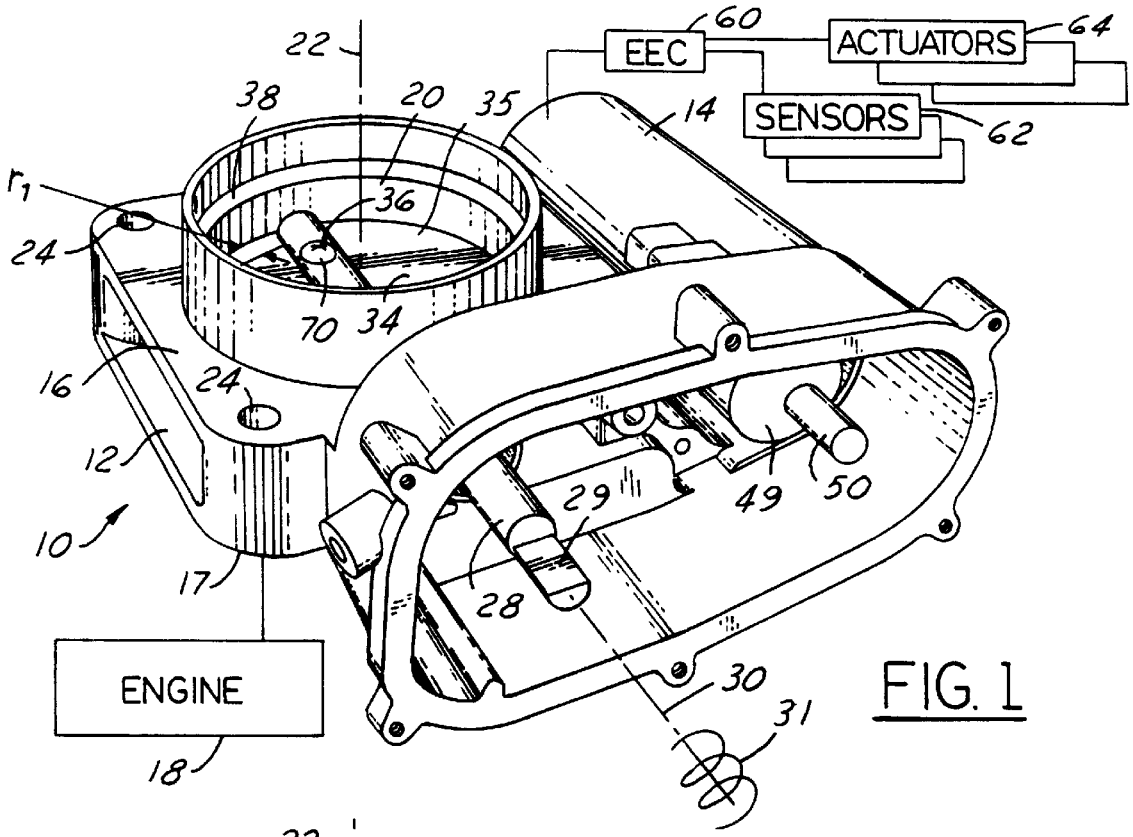
Figure 2:
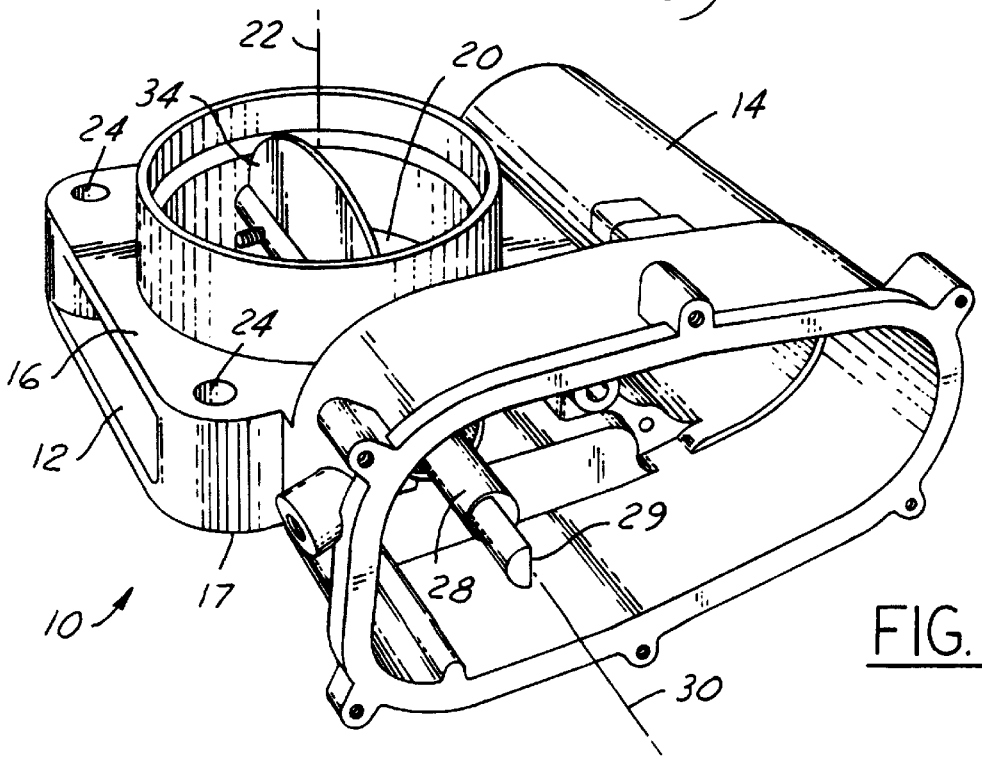

Referring to FIGS. 1–3, according to the present invention electronic throttle valve 10 includes throttle body 12 coupled to motor housing 14. Throttle body 12 has upper flat surface 16 adapted to be connected to an air induction system (not shown) and lower flat surface 17 adapted to be connected to engine 18. Throttle body 12 has throttle bore 20 with a bore centerline 22 axially located perpendicular to upper flat surface 16. Throttle body 12 also has mounting holes 24 axially located perpendicular to upper flat surface 16. Throttle body 12 has throttle shaft 28 defining axis 30, which is generally parallel to upper flat surface 16 and the lower flat surface (not shown). Shaft 28 also has notch 29 adapted to be connected to a motor drive train (not shown for the sake of clarity). Throttle plate 34 is connected to throttle shaft 28 via screws 36. Throttle plate 34, which has an elliptical exterior shape, has upper throttle surface 35 and lower throttle plate surface 37. Shaft 28 is also connected to biasing spring 31 for urging throttle plate 34 towards a limp home position, shown in FIG. 3 and more particularly described later herein.

Throttle plate 34 also has upper relief 38 (shown in this example as a stepped edge) in upper throttle plate surface 35 and lower relief 39 (also shown in this example as a stepped edge) in lower throttle plate surface 37, which allows throttle plate 34 to seal with throttle bore 20 with an easily manufactured geometry. Thickness t1 (see FIG. 6*a*) of upper stepped edge 38 and thickness t2 (see FIG. 6*a*) of lower stepped edge 39 are equal such that the total thickness t3 of throttle plate 34 is the sum of thickness t1 and t2. Upper stepped edge 38 also has constant radial width r1 (see FIG. 1) which is equal to constant radial width r2 (see FIG. 3) of lower stepped edge 39. Upper stepped edge 38 extends approximately half way around throttle plate 34, starting and ending at throttle shaft 28. Similarly, upper stepped edge 39 extends approximately half way around throttle plate 34, starting and ending at throttle shaft 28. However, lower stepped edge 39 is on the opposite side of shaft 28 as upper stepped edge 38. According to the present invention, stepped edges 38, 39 allow throttle plate 34 to rotate past a full open position (see FIG. 2) to a limp home position (see FIG. 3), which will be described later herein with particular reference to FIGS. 6*a*–6*b*. Motor housing 14 surrounds electric motor 49 (see FIG. 1) with output shaft 50 axially located parallel to axis 30 of shaft 28 to drive shaft 28 via the not shown drive train. The electric motor is controlled by powertrain control module (PCM) 60. PCM 60 also communicates with various sensors 62 and actuators 64.

Referring now specifically to FIG. 1, valve 10 is shown in an idling engine operating condition. Throttle plate 34 is an a position that allows a small amount of airflow necessary for maintaining idling operation of the engine. Screws 36 are in a position where screw head 70 is shown, along with upper throttle surface 35 and upper stepped edge 38.

Referring now specifically to FIG. 2, valve 10 is shown in a near maximum power position, where throttle plate 34 has been rotated approximately a quarter of a full rotation from the position shown in FIG. 1. Throttle plate 34 is in a position that allows near maximum airflow.

Referring now specifically to FIG. 3, valve 10 is shown in the limp home position in which throttle plate 34 has been rotated nearly one half of a full rotation from the position shown in FIG. 1 and approximately one quarter of a full rotation from the position shown in FIG. 2. Screws 36 are in a position where bottom screw portion 72 is shown, along with lower throttle surface 37 and lower stepped edge 39. Of course, to obtain the limp home position, some airflow is necessary. Thus, plate 34 is prevented from fully closing off airflow through bore 20 by the use of appropriately positioned throttle plate limp home stop (not shown) Referring now to FIGS. 4*a*–4*f* and specifically to FIG. 4*a*, the closed in bore position of throttle plate 34 is shown for the present invention with an arrow indicating the allowed direction of travel. Referring now to FIG. 4*b* for comparison, the closed in bore position of a throttle plate is shown for the prior art along with an arrow indicating the allowed direction of travel. Referring now to FIG. 4*c*, the open throttle position of throttle plate 34 is shown for the present invention with arrows indicating the allowed directions of travel. In particular, the present invention has a throttle plate 34 that can move away from the open throttle position in either direction. This ability is due to upper stepped edge 38 and lower stepped edge 39, which will be described later herein with particular reference to FIGS. 6*a*–6*b*. Referring now to FIG. 4*d* for comparison, the open throttle position of a throttle plate is shown for the prior art with an arrow indicating the allowed direction of travel. Referring now to FIG. 4*e*, the limp home throttle position of throttle plate 34 is shown for the present invention with an arrow indicating the allowed direction of travel. This limp home position is approximately one half of a complete rotation from the closed in bore position of the present invention. Referring now to FIG. 4*f* for comparison, the limp home throttle position of a throttle plate is shown for the prior art with an arrow indicating the allowed directions of travel, with the limp home position being in between the minimum and maximum airflow positions.

Referring now to FIGS. 5*a*–5*b* and specifically to FIG. 5*a*, a plot of the spring torque on a throttle plate versus the throttle angle of rotation (θ) is shown for prior art systems. When the throttle valve of prior art systems is under no external forces (i.e. from the not shown motor), the throttle plate will move in a direction of less absolute value of spring torque. Thus, the rest position, under no external force, is the limp home position. In particular note the change in spring torque direction at the limp home position, which is between the closed position (closed stop) and the maximum open position (open stop). Also, this limp home position is in the range of positions experienced during engine idling operation. Referring now to FIG. 5*b*, a plot of the spring torque on throttle plate 34 versus the throttle angle of rotation (θ) is shown for the present invention. When throttle valve 10 of the present invention is under no other external force, throttle plate 34 will move in the direction of decreasing the spring torque until throttle plate stops at the limp home position, which is past the maximum airflow position. In other words, throttle plate 34 will move to the limp home position when under no other external force other than the spring torque.

Referring now to FIGS. 6*a*–6*b*, cross-sectional views of valve 10 are shown. In FIG. 6*a*, a cross-sectional view of throttle plate 34 in the closed position described previously herein with particular reference to FIG. 4*a* is shown. The cross section shown represents a planar cross-section of valve 10 parallel to bore centerline 22 and perpendicular to shaft axis 30 along throttle shaft 28. Upper stepped edge 38 has first edge 80 which is perpendicular to upper plate surface 35 as well as perpendicular to lower plate surface 37. In addition, upper stepped edge 38 has second edge 82 which is parallel to both upper plate surface 35 and lower plate surface 37. Upper stepped edge 38 also has third edge 84 which is parallel to bore surface 78. Lower stepped edge 39 has fourth edge 86 which is perpendicular to upper plate surface 35 as well as perpendicular to lower plate surface 37. In addition, lower stepped edge 39 has fifth edge 88 which is parallel to both upper plate surface 35 and lower plate surface 37. Lower stepped edge 39 also has sixth edge 90 which is parallel to bore surface 78 and third edge 84. According to the present invention, second edge 82 and fifth edge 88 lie in the same plane along centerline 92 of plate 34. FIG. 6*b* represents valve 10 when throttle 34 is in the limp home position.

As previously described, thickness t1 of upper stepped edge 38 and thickness t2 of lower stepped edge 39 are equal such that the total thickness t3 of throttle plate 34 is the sum of thickness t1 and t2. According to the present invention, thickness t3 is preferably defined by the following equation:

$$t3 < D \times \tan Ø,$$

where:

D is the diameter of throttle bore 20; and,

Ø is the angle of the throttle plate when in the closed position.

Figure 7A:
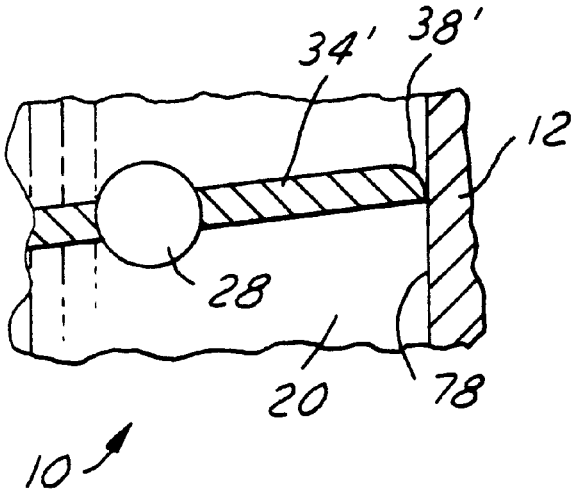
Figure 7B:
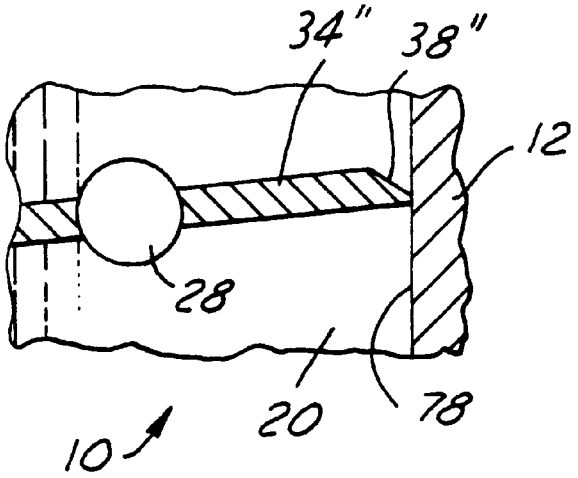

Turning now to FIGS. 7*a* and 7*b*, alternative embodiments of the present invention are shown. For the sake of clarity, only one side of plate 34 in bore 20 is shown in FIGS. 7*a* and 7*b*. In FIG. 7*a*, relief 38 is formed as a curved edge 38' in upper throttle plate surface 35. The curvature is sized so as to allow plate 34 to operate past the maximum power position as previously described. In FIG. 7*b*, relief 38 is formed as a chamfered edge 38" in upper throttle plate surface 35. The chamfer is sized so as to allow plate 34 to operate past the maximum power position as previously described. Of course, those skilled in the art will recognize in view of this disclosure that other configurations for relief 38 may be used which will allow plate 34 to operate past the maximum power position as described in this specification.

While the best mode for carrying out the invention has been described in detail, those skilled in the art in which this invention relates will recognize various alternative designs and embodiments, including those mentioned above, in practicing the invention that has been defined by the following claims.

What is claimed is:

1. An electronically controlled throttle valve for use with an internal combustion engine, said valve comprising:

a throttle body for communication between an intake port of the engine and an ambient atmosphere, said throttle body having a passageway with a circular cross-section and a longitudinal axis;

an elliptically-shaped throttle plate located in said throttle body, said throttle plate having an upper plate surface having an upper relief and a lower plate surface having a lower relief, with said reliefs allowing said throttle plate to rotate past a full power position substantially parallel to said longitudinal axis of said passageway;

said throttle plate having a normal operating range of positions in said passageway with a first closed position substantially transverse to said longitudinal axis of said passageway and a second position at said full power position said throttle plate contacting said passageway bore in said first closed position;

a biasing means biasing said throttle plate away from said normal operating range past said full power position to a low power position.

2. The valve recited in claim 1 wherein each said relief is formed as a stepped edge.

3. The valve recited in claim 1 wherein each said relief is formed as a curved edge.

4. The valve recited in claim 1 wherein each said relief is formed as a chamfered edge.

5. The valve recited in claim 1 wherein said upper relief extends over approximately half said throttle plate.

6. The valve recited in claim 5 wherein said lower relief extends over approximately half said throttle plate.

7. The valve recited in claim 6 wherein said upper relief extends over approximately half said throttle plate and said lower relief extends over approximately half said throttle plate, wherein said lower relief occupies an opposite side of said throttle plate as said upper relief.

8. The valve recited in claim 2 wherein said biasing means urges said throttle plate in only one direction.

9. An electronically controlled throttle valve mechanism for use with an internal combustion engine, said valve mechanism comprising:

a throttle body, said throttle body having a cylindrical bore for communication between an intake port of the engine and the ambient atmosphere;

a throttle plate rotatably positioned in said cylindrical bore, said throttle plate having an elliptical shape with a first curved edge extending along approximately a first one-half of said throttle plate and a second curved edge extending along approximately the second one-half of said throttle plate;

said first curved edge having a first reduced thickness portion along its length and positioned on a first side of said throttle plate, said second curved edge having a second reduced thickness portion along its length and positioned on a second side of said throttle plate, said throttle plate being rotatable in said bore between a first position wherein said throttle plate is in a first closed position blocking air flow through said bore, a second full power position wherein said throttle plate allows a substantially full complement of air flow through said bore, and a third low power position wherein said throttle plate is in a position to block a significant portion of the air flow through said bore;

said second position being situated between said first and third positions of said throttle plate; and a biasing spring biasing said throttle plate toward said third position;

wherein in the event of electronic failure of said throttle valve mechanism, said throttle plate which during normal engine operation rotates between said first and second positions, will rotate by virtue of said biasing spring and said first and second reduced thickness portions, to said third position.

10. The valve mechanism as set forth in claim 9 wherein said first and second reduced thickness portions each comprise a stepped edge configuration.

11. The valve mechanism as set forth in claim 9 wherein said first and second reduced thickness portions each comprise a curved edge configuration.

12. The valve mechanism as set forth in claim 9 wherein said first and second reduced thickness portions each comprise a chamfered edge configuration.

13. An electronically controlled throttle valve for use with an internal combustion engine, said valve comprising:

a throttle body for communication between an intake port of the engine and an ambient atmosphere, said throttle body having a passageway with a circular cross-section and a longitudinal axis;

a throttle plate rotatably positioned in said passageway, said throttle plate having an elliptical shape;

said throttle plate having a normal operating range of positions in said passageway with a first closed position substantially transverse to said longitudinal axis of said passageway and a second full power position substantially parallel to said longitudinal axis of said passageway;

a spring member biasing said throttle plate in the direction away from said normal operating range and through said second full power position to a third lower power position;

said throttle plate contacting said passageway bore in said first closed position;

said throttle plate having relief areas along its outer edges and on opposite sides thereof in order to allow rotation through said second full power position to said third lower power position, said relief areas comprising stepped edges.

* * * * *